United States Patent [19]

Rosen et al.

[11] 4,346,483

[45] Aug. 31, 1982

[54] FLOAT CONTROLLED LIQUID DISPENSER

[75] Inventors: Robert A. Rosen; Gayle F. Schuchmann, both of St. Louis; James E. Pate, Winchester, all of Mo.

[73] Assignee: Puro Corporation, St. Louis, Mo.

[21] Appl. No.: 202,701

[22] Filed: Oct. 31, 1980

[51] Int. Cl.[3] ..... E03D 9/02; E03D 9/03

[52] U.S. Cl. ..... 4/227; 222/57

[58] Field of Search ..... 4/222, 227, 228; 222/56, 57, 453, 563, 564

[56] References Cited

U.S. PATENT DOCUMENTS

| | | | |
|---|---|---|---|
| 2,913,734 | 11/1959 | O'Hare | 4/227 |
| 2,967,310 | 1/1961 | O'Hare | 4/227 |
| 3,698,021 | 10/1972 | Mack et al. | 4/227 |
| 3,774,808 | 11/1973 | LaVange | 4/227 X |
| 3,841,524 | 10/1974 | Easter | 4/227 X |
| 3,908,209 | 9/1975 | Fillmore | 4/228 X |
| 3,965,497 | 6/1976 | Corsette | 4/228 |
| 4,036,407 | 7/1977 | Slone | 4/228 X |
| 4,066,187 | 1/1978 | Nieman et al. | 4/228 X |
| 4,131,958 | 1/1979 | Dolan | 4/228 |
| 4,294,369 | 10/1981 | Racine | 4/227 X |

*Primary Examiner*—Charles E. Phillips

*Attorney, Agent, or Firm*—Haverstock, Garrett & Roberts

[57] ABSTRACT

This invention relates to a float controlled dispenser for automatically releasing predetermined amounts of a detergent or a bacteriostatic liquid into the flush tank of a toilet bowl whenever the bowl is flushed. The dispenser comprises a bottle necked container mounted in an inverted position in the flush tank and a dispensing valve assembly consisting of a plug having a tapered end and force fitted into the neck portion of the bottle, said plug having a central orifice circumscribed by an annular planar valve seat and of a bell shaped float member having an annular measuring chamber in which is centrally located a vertical fluted stem projection for limiting the float's up and down movement within the plug's central orifice. The base of the stem projection is circumscribed by an annular planar surface for sealing contact with the plug's planar annular surface. The end of the vertical stem projection has an enlarged cross-section to retain it in the plug's central orifice to allow the float member to descend to a position such that the top edge of the measuring chamber substantially coincides with the plug's annular surface. The outer surface of the float member is provided with longitudinal ribs to guide the float member in its up and down movement within the plug, the ends of said ribs being tapered inwardly to conform to the internal tapered surfaces of the plug. For shipping purposes, the dispenser is also provided with a disposable cap threaded over external threads on the bottle neck.

7 Claims, 9 Drawing Figures

FLOAT CONTROLLED LIQUID DISPENSER

FIELD OF THE INVENTION

This invention relates to improvements in float controlled liquid dispensing apparatus for discharging a measured quantity of liquid from one container into another container and more particularly a toilet bowl flush tank during the period when the flush tank is being refilled with water after its contents had been flushed into the toilet bowl.

DESCRIPTION OF THE PRIOR ART

Liquid dispensers for toilet tank additives as shown in the prior art either discharge the additive as the tank contents are discharged or flushed into the toilet bowl or as the tank fills after a discharge. The first type in which the additive is discharged into the toilet tank as it discharges are exemplified by U.S. Pat. No. 3,841,524 to Avard Joseph Easter; U.S. Pat. No. 3,908,209 to William E. Fillmore; U.S. Pat. No. 3,965,497 to Douglas F. Corsette; U.S. Pat. No. 4,036,407 to Thomas J. Slone; and U.S. Pat. No. 4,131,958 to John E. Dolan. The second type of liquid dispenser wherein the liquid additive is discharged into the tank while it is being refilled is exemplified by U.S. Pat. No. 2,913,734 to H. M. O'Hare; U.S. Pat. No. 2,967,310 to H. M. O'Hare and U.S. Pat. No. 3,698,021 to Frank J. Mack et al.

An advantage alleged for the first type of dispenser is that a higher concentration of additive remains in the toilet bowl after flushing than that obtainable from use of the second type of dispenser. On the other hand, it would appear less of the additive would be present in the toilet tank to inhibit bacterial growth, algae formation or other harmful agents in the contents of the water tank particularly when the toilet is infrequently flushed. It may be noted, however, that bacteriostatics useful as toilet tank additives quite frequently are fully effective at extremely low dilutions, for example U.S. Pat. No. 3,897,357 describes a toilet tank additive based on the use of 5-chloro-2-(2,4-dichlorophenoxy) phenol which exhibits bacteriostatic properties against *S. aureus, P. miribalis* and *E. coli* at levels as low as 0.2 parts per million for a liquid cleaning formulation. Consequently, the somewhat higher concentration of the additive in the toilet bowl if present at all, from the use of the first type of dispenser is not a significant factor especially since such dispensers have a more complicated structure and are more costly to manufacture than dispensers of the second type.

The relatively simple structures of the second type of dispenser makes them economical to produce and assemble. They usually comprise two members, one being an apertured plug either to be inserted in the additives bottle neck or to encapsulate the bottle neck. The other member is a two compartment float having one compartment functioning as an air bell and the other compartment as an additive receptive chamber as well as a sealing means for the aperture or orifice of the plug. As mentioned in U.S. Pat. No. 3,698,021 this type of dispenser has many problems such as dispensing inconsistent amounts of cleanser, permitting water to leak into the container or are inoperable unless constructed from a rigid material such as glass. The structure described in U.S. Pat. No. 3,698,021 is dependent on the use of a shroud, threaded over the additive container's neck and a cap threaded over the shroud. Thus this assembly requires two threading operations in order to first install the shroud and float assembly to the bottle neck, and then to install the cap over the shroud and float assembly.

SUMMARY OF INVENTION

It has now been found that the inconsistent dispensing of the known dispensers of the type which dispenses a liquid additive during the tank refilling operations is often caused by failure of the float part of the assembly to reliably and consistently seal off the contents of the dispenser bottle upon completion of the tank refill causing leakage of the container's contents into the tank. Inconsistent delivery of the desired liquid dosage from the additive container can also be caused by inadequate air venting of the additive container in replacement of liquid discharged from the container.

The present invention is particularly directed to solving the problems of leakage, variable and inconsistent liquid dosage amounts and inadequate venting of the additive container. The present invention embodies several novel features which jointly and severally contribute to help overcome the aforementioned problems. In essence, the invention depends on a dispensing apparatus comprising a float member having an air bell chamber at one end and an annular liquid receiving chamber at the other end and a plug insert member for force fitting in the additive container's bottle neck. The insert plug has an orifice for receiving liquid from the additive container and discharging the liquid into the annular chamber in the float member. Said orifice is circumscribed by a planar annular sealing surface coacting with a similar planar annular sealing surface in the base of the liquid receiving chamber of the float member to seal the orifice when the float member is pushed upwardly by a rising water level in the toilet tank. The insert plug has a tapered leading surface to facilitate force fit insertion into the bottle neck of the additive container.

The float member employed in this invention has external and internal tapered surfaces spaced from similar tapered surfaces in the insert plug to provided space therebetween for liquid additive discharged from the liquid chamber of the float member to descend therefrom into the toilet tank.

A guide stem extending axially upwardly from the base of the annular liquid receiving chamber in the float member and through the orifice in the insert plug has radially extending fingers at its outermost end for securing the float to the insert plug. The radial fingers on the guide stem are so positioned that when the float member moves downwardly due to a receding water level in the tank, its downward movement is stopped by the radial finger's engagement with that surface around the orifice closest to the bottle neck. The radial fingers normally stop the downward movement when the rim of the liquid receiving chamber is substantially coplanar with the planar annular sealing surface in the insert plug.

When the float member is in the downward position, the liquid additive in the bottle flows through the orifice in the insert plug until the liquid receiving chamber in the float member is filled to its brim with liquid additive. No further flow of liquid occurs because the coplanar relationship of the annular sealing surface in the insert plug with the liquid at the brim of the liquid receiving chamber in the float member creates an air lock against entry of air in the bottle to relieve the slight vacuum generated in the bottle upon discharge of its liquid contents. The air lock, however, is self regulating whereby whenever too high a vacuum is present in the bottle, outside atmospheric air at normal pressure can bleed between the insert plug's annular sealing surface and the surface of the liquid in the float member's liquid receiving chamber. During such air bleeding, the air as it moves upwards through the orifice in the insert plug and into the bottle, entrains the liquid attempting to move through said orifice and thus inhibits further discharge of liquid into the float member's liquid receiving chamber. The liquid then present in this chamber is expelled into the toilet tank when the water in the tank rises sufficiently to lift the float member into a sealing contact with the annular sealing surface in the insert plug.

DESCRIPTION OF A PREFERRED EMBODIMENT

Referring now to the accompanying drawing, the float controlled dispenser bottle assembly of this invention indicated generally by 10 in FIGS. 1, 2, 8 and 9 has a clip hanger 12 for mounting assembly 10 in an inverted position in a conventional water tank 11. Hanger 12 is fastened to bottle 14 by means not shown such as rivets, adhesive or the like. Bottle 14 may be molded from a rigid substance such as glass or vitrified clay. Preferably, however, bottle 14 is molded from a resilient thermoplastic organic polymer such as polyethylene, polypropylene, polyvinylchloride, ABS polymers and other polymers of similar properties because such polymers can be molded into thin walled light weight containers not readily subject to breakage as in the instance of ceramic containers. The same plastic materials are eminently satisfactory for molding the two parts of the dispenser.

Figure 3:
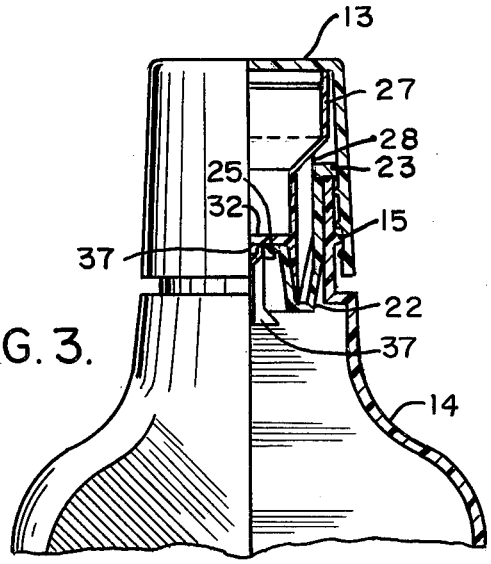
FIG. 3 is a fragmentary view in elevation and in section showing a toilet tank additive bottle fitted with a float controlled dispenser of this invention, the dispenser being held in a closed position by a cap threaded on external threads on the bottle neck. The bottle and dispenser as shown can be shipped or shelf stored without leakage.
Figure 4:
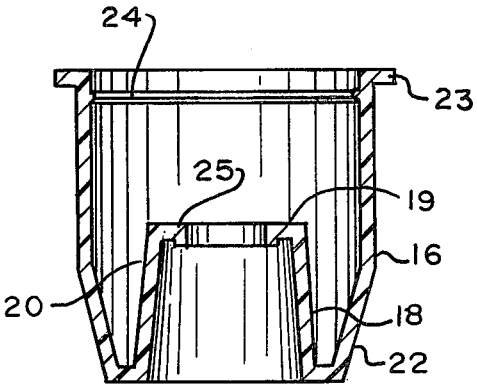
FIG. 4 is a sectional elevation view of an insert plug showing an annular sealing surface around the orifice and a leading tapered end providing ease of entry into the neck end of the bottle, the plug being dimensioned for a force fit in the bottle neck.
Figure 8:
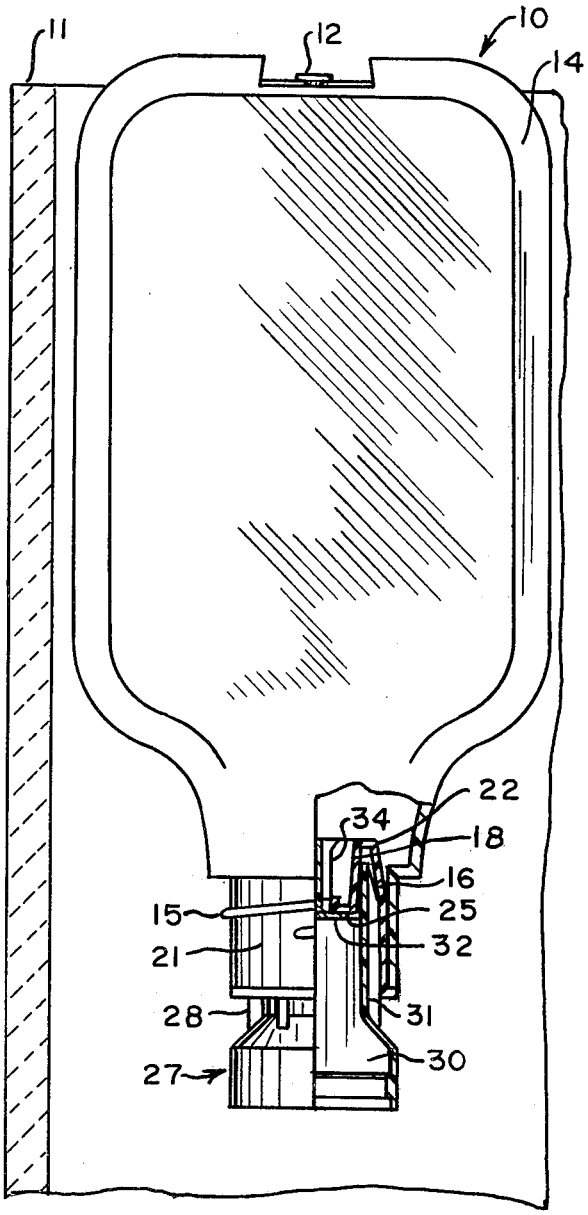
FIG. 8 is an enlarged view in elevation and section of the inverted bottle and dispenser assembly shown in FIGS. 1 and 2 with the two planar annular sealing surfaces of the insert plug and float member abutting against each other to seal off the liquid contents of the bottle, after the air bell portion of the dispenser assembly has been pushed sufficiently upwards by the water in the toilet tank.
Figure 9:
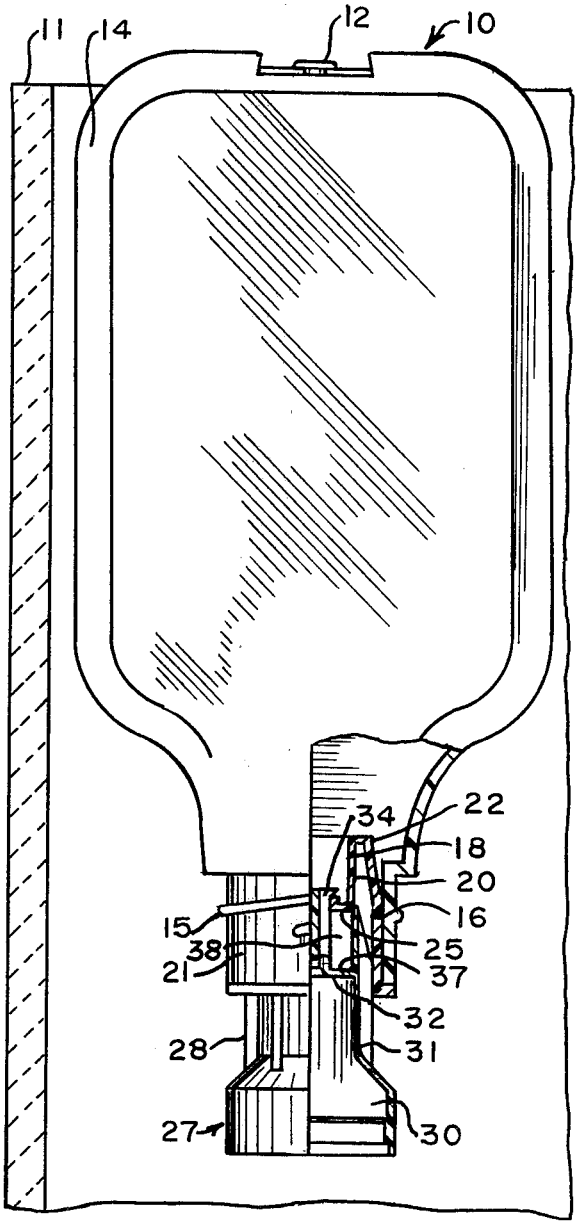
FIG. 9 is an enlarged view in elevation and section similar to FIG. 8 but showing the float member in a down or open position, as occurs when the water level in the tank descends below the air bell section of the float member, and with the opposing annular planar surfaces separated from each other permitting liquid in the bottle to flow into the float member's annular chamber.

As shown in FIG. 3 the liquid contents of bottle 14 are sealed during shipment and/or shelf storage by an internally threaded cap 13 engaging external threads 15 on the neck portion 21 of bottle 14 (as indicated in FIGS. 8 and 9). The internal base surface of cap 13 bears against the terminal air bell rim portion of float member 27 to concentrically press planar annular sealing surface 37 in the base of liquid receiving annular chamber 38 of float member 27 against the corrrespondng annular planar surface 25 around orifice 19 in plug 16. Enlarged views of planar surfaces 25 and 37 are respectively shown in FIGS. 4 and 5. A thin walled insertable plug 16 (average wall thickness, 0.045 inch) as shown in the enlarged view of FIG. 4 has an outwardly extending integral rim portion 23 which extends over the rim of the bottle neck of bottle 14 and functions as a stop to control the insertion depth of insert plug 16 into the bottle neck 21. An internal peripheral reinforcing rib 24 is a desirable optional feature for strengthening the walls of insert plug 16 furthermore for presenting a minimum frictional surface area against which longitudinal ribs 38 of float member 27 bear when float 27 rises or decends. Rib 24 is preferably positioned adjacent to rim portion 23. The major axial length of insert plug 16 is cylindrical in cross-section, but the lower portion of plug 16 has an inwardly tapering frustro conical shape 22 to guide and help insertion of plug 16 into bottle neck 21. The outer diameter of the cylindrical portion of insert plug 16 exceeds the internal diameter of bottle neck 21 sufficiently to make for a force fit in bottle neck 21. For example, a molded polyethylene bottle whose neck portion 21 has an internal diameter of 0.997 inch is satisfactorily force fitted by a polyethylene insert plug 16 having an external diameter of 1.027 inches to provide a leak proof fit between the inner surface of the bottle neck 21 and the exterior cylindrical surface of insert plug 16.

Extending upwardly from the tapered base of insert plug 16 is a frustro conical protuberance 18 having a circular aperture or orifice 19 concentric with the vertical axis of plug 16. A planar annular valve seat 25 at the terminus of protuberance 18 circumscribes orifice 19.

The tapered vertical walls 20 of protuberance 18 have a degree of taper equivalent to a tapered surface 33 in float member 27; its significance will be explained later.

Figure 6:
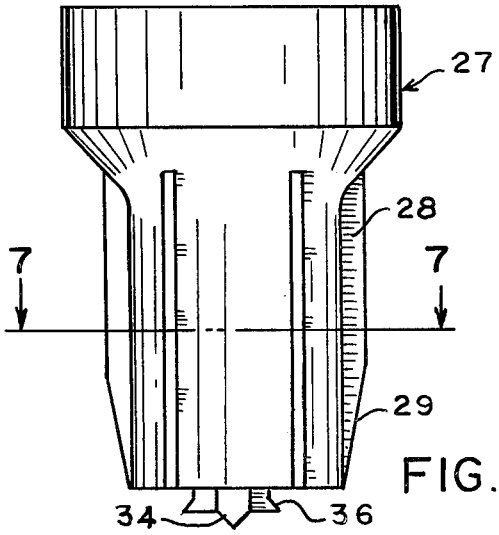
FIG. 6 is an elevational view of the float member depicted in FIG. 5 and illustrates longitudinal guiding ribs on its outer surface, said ribs tapering inwardly conformably to the tapered interior wall surface of the insert plug's tapered end.
Figure 5:
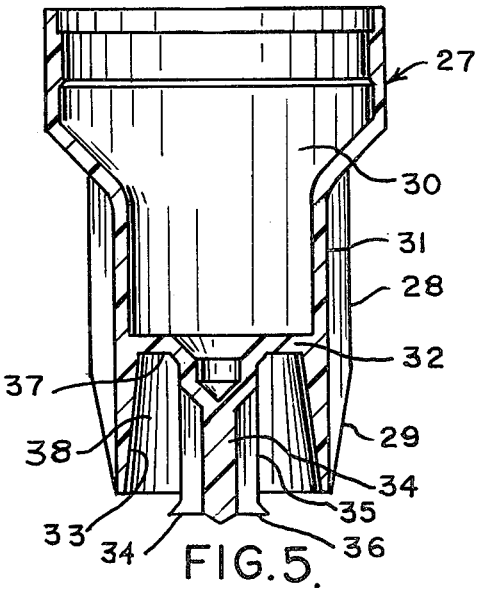
FIG. 5 is a sectional elevation view of the float member of the dispenser showing an air bell chamber separated by an integral bulkhead from an annular liquid additive receiving chamber and a fluted guide stem projection integral with the base of said annular chamber, said stem projection having on its outer end radially projecting retaining fingers.
Figure 7:
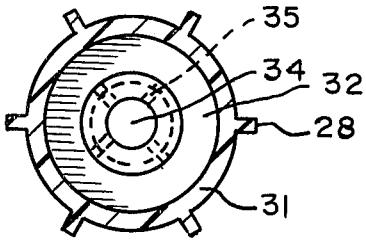
FIG. 7 is a section of the float member taken along the line 7—7 of FIG. 6.

Referring now to FIGS. 5, 6 and 7, illustrating float member 27, it will be observed that float member 27 is divided into two compartments 30, 38 by a bulkhead 32. The upper compartment 30 functions as an air bell and the lower compartment 38 is a frustro annular chamber for receiving liquid from bottle 14 and subsequently discharging the liquid into the toilet tank 11 when float 27 is pushed upwardly by a rising water level in tank 11.

The exterior cylindrical surface 31 of float member 27 is provided with a plurality of longitudinally extending spacing ribs 28 whose function is to center float member 27 within the inner walls of the cylindrical portion of insert plug 16. The thickness of ribs 28 is such that a radial clearance of about 0.018 to 0.020 inch exists between the ribs peripheral surface and the cylindrical inner wall of insert plug 16. Below bulkhead 32, each rib 28 has an inwardly directed taper 29 slightly less than the internal taper 22 on the tapered end of insert plug 16. For example, a taper of 12° 30′ on tapered ribs 29 has a negligible sliding friction against a 15° interior tapered surface 22 of insert plug 10 but importantly is most effective in concentrically aligning planar annular surface 25 of insert plug 16 with planar annular surface 37 of float member 27 to provide a leak proof seal when it is pushed upward by a rising water level in tank 11 into a closed position.

Axially extending downwardly from bulkhead 32 is a fluted guide stem 34 having a plurality of longitudinally extending ribs 35 on its peripheral surface which terminate in radially extending retaining fingers 36 that prevent float member 27 from separating from insert plug 16 after guide stem 34 has been forced through orifice 19 of insert plug 16. When float member 27 is freely suspended as occurs when bottle 14 is held in an inverted position and the water level in tank 11 is below the rim of the air bell portion of float member 27, the radially extending fingers 36 on guide post 34 limit the downward movement of the float member to a position wherein the rim of liquid receiving chamber 38 is substantially coplanar with the annualr sealing surface 25 in insert plug 16. The term "substantially coplanar" is intended to define a range from a true coplanar position to at most a depth penetration of insert plug's annular planar surface 25 into liquid recovery chamber 38 of about 0.050 inch. The outwardly tapering wall 33 of liquid receiving chamber 38 in a typical example of this invention has a taper of about 5° corresponding to a 5° taper on the outer wall 20 of protuberance 18 of insert plug 16.

Figure 1:
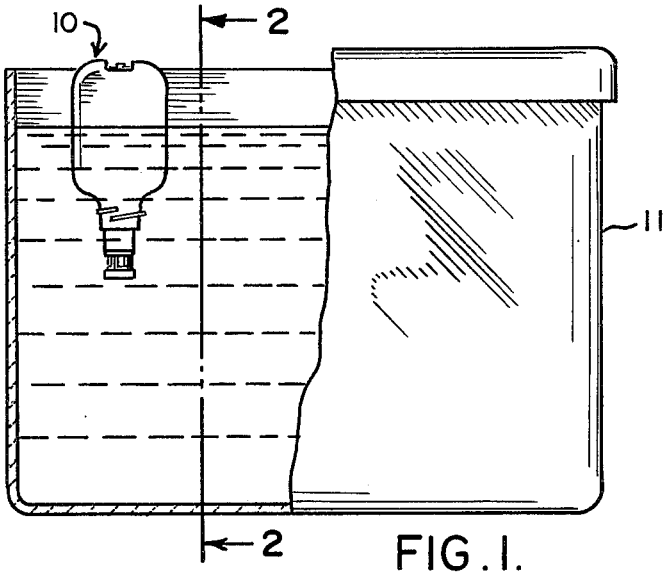
FIG. 1 is a fragmentary view in elevation and in section of a toilet tank in which a suspended inverted liquid additive bottle has attached thereto a float controlled dispenser embodying the principles of this invention. As shown, the dispenser float member is being held in an up or closed position by the buoying force of the water in the tank pushing the air bell portion of the float member in an upward direction and sealing off the contents of the bottle.
Figure 2:
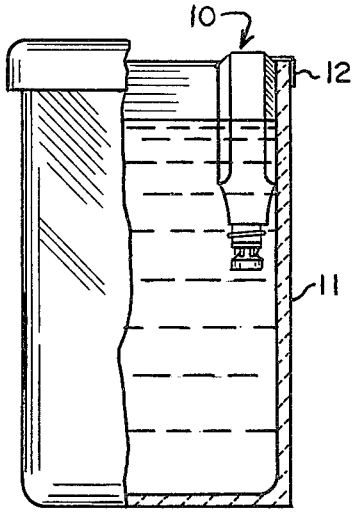
FIG. 2 is a fragmentary side elevation view, partly in section along the line 2—2 of FIG. 1 illustrating a hook member for suspending the bottle from the top edge of the tank in an inverted position in the toilet tank.

The combination of the several tapered surfaces 20 and 22 in insert plug 16 mating respectively with corresponding tapered surfaces 29 and 33 of float member 27 is of great importance in insuring that every time float member 27 is pushed upwards by a rising water level in tank 11, axial alignment of its planar annular valve seat 37 with the planar annular valve seat 25 in float member 16 is obtained thereby producing a leak proof seal each time after tank 11 is flushed and refilled with water. The efficacy of this sealing action was demonstrated in a comparative test of a float controlled dispenser assembly according to this invention with a float controlled dispenser of the prior art of similar dimensions and shape but which has only longitudinal spacing ribs on the float member and no tapered ends on such ribs and no tapered surface on the wall of its liquid receiving chamber corresponding to wall 33 of the present invention. Each dispenser valve was attached to a liquid additive bottle containing 12 fluid ounces (375 grams) of liquid additive and each dispenser bottle assembly was mounted in a toilet tank as shown in FIGS. 1 and 2 hereof. The tanks were repeatedly flushed until the bottles were empty. The float controlled dispenser assembly of this invention in repeated tests yielded between 285 and 300 flushes before the additive bottle was empty. The prior art float controlled dispenser assembly in repeated tests had a maximum of 215 flushes before its bottle was empty of its contents. The higher yield of flushes by the dispenser assembly of this invention is obviously of economic importance to the consumer. As was noted previously, the toilet tank liquid additives available today are extremely potent when dispersed in low concentrations into a toilet tank, consequently there is an economic waste when more of the additive is dispensed than needed.

Additional tests with the float controlled dispenser assembly of this invention revealed a maximum of about 10% variation per dosage of liquid additive discharged from the bottle from when the bottle was full to when it was practically empty. This substantially uniform dosage is in part attributed to the highly effective sealing action obtained between the two planar annular sealing surfaces 25 and 37 and in part due to the rim of liquid receiving chamber 38 of float member 27 being substantially coplanar with the annular sealing surface 25 of insert plug 16 when float member 27 is in an open or down position as shown in FIG. 9. In this position after chamber 38 of float member 27 has been filled with additive liquid up to its rim, further flow of liquid therein from bottle 14 ceases upon the liquid surface in chamber 38 contacting annular sealing surface 25 of insert plug 16 because the hydraulic head of liquid in the bottle is then counterbalanced by the slight vacuum above the top surface of the liquid in the bottle resulting from outflow of the liquid of the bottle without a corresponding volume of air entering the bottle to fully compensate for the amount of liquid discharged from the bottle. During operation a slight vacuum is always present in the bottle, but if the vacuum were to reach a higher level, erratic discharge of fluid from the bottle would result. This does not happen with the float controlled dispenser assembly of this invention because of the extremely close interface proximity of the rim of liquid chamber 38 to annular sealing surface 25 of insert plug 16 when float member 27 is in a down or open position. This interface enables air to pass between the interfacing surfaces in sufficient amount to stabilize the vacuum above the liquid in the bottle and on the other hand the surface tension of the liquid in chamber 38 acting on annular surface 25 inhibits leakage of liquid over the rim of said chamber.

Although the utility of the float controlled liquid dispenser assembly of this invention has been described in the specification and illustrated in the drawing with respect to use as a dispenser in toilet tanks it will be obvious to those skilled in the art that the assembly can be utilized in other applications requiring metered dosages to be discharged from one container into another vessel whose liquid contents are periodically charged and discharged as for example animal or bird watering troughs, automatic clothes or dish washing machines and the like. Furthermore, changes in the shape, size and proportions of the float member and the associated insert plug which do not depart from the principles of this invention are all within the contemplation of the appended claims.

What is claimed is:

1. A liquid dispensing apparatus for periodically discharging a measured quantity of liquid from a bottle necked container into a second liquid container comprising in combination (1) a thin walled cylindrical plug of resilient plastic material adapted to be force fitted into the bottle neck of the first container, the leading portion of said insert being inwardly tapered to facilitate insertion in said bottle neck, said plug insert having a tapered frustro conical protuberance extending interiorly and upwards from the tapered end of the plug insert and terminating part way in the cylindrical interior of said plug insert, the inner end of said protuberance having a planar annular surface perpendicular to the longitudinal axis of said insert plug and an orifice through said planar surface concentric with the axis of said insert plug and (2) a cylindrical two compartment plastic float member adapted for axial movement within the cylindrical portion and within the leading inwardly tapered portion of said plug insert, one compartment consisting of an air bell and the other compartment consisting of an annular frustro conical chamber dimensioned for spaced entry therein of the conical protuberance portion of said plug insert and for receiving liquid from the orifice in said plug insert, said chamber having in its base an annular planar valve seat coaxial with the annular planar surface in said plug insert, an integral guide stem axially extending from the base of the frustro conical chamber and slightly beyond the rim of said chamber, said guide stem being freely axially movable in the plug insert's orifice but retained therein by fingers radially projecting from the end of said guide stem, and integral means on the exterior cylindrical surface of said plastic float member for spacing said float member from the interior cylindrical wall and the tapered end of the plug insert and for concentrically guiding the float's annular planar valve seat into a liquid sealing contact with the annular planar surface on said plug insert.

2. A liquid dispensing apparatus according to claim 1 wherein said float member has a plurality of vertical ribs extending along the length of said float member said ribs having an inward taper along that section of the float member enclosing the liquid receiving chamber, said taper essentially conforming to the taper on the tapered end of the insert plug.

3. A liquid dispensing apparatus according to claim 2, wherein the inwardly directed taper of the float member's vertical ribs is less than the taper present on the internal surface of the leading portion of the plug insert and the outwardly tapering wall of the annular frustro conical chamber in the float plug has substantially the same degree of taper as the degree of taper on the outer wall of the frustro conical protuberance in said plug insert.

4. A liquid dispensing apparatus according to claim 2 wherein the thin walled cylindrical plug is provided with an internal perpherial rib to provide a low friction surface area for axial movement thereover of the float members vertical ribs.

5. A liquid dispensing apparatus according to claim 1 wherein the outer frustro conical wall of the protuberance in the plug insert has a taper equivalent to the taper present on the interior wall of the frustro conical wall of the liquid receiving chamber in the float member.

6. A liquid dispensing apparatus according to claim 1 wherein the guide stem in the float member has its radially extending fingers positioned slightly beyond the rim of the liquid receiving chamber in said float member whereby when the float member when freely suspended from the insert plug on said fingers has the rim of the liquid receiving chamber positioned substantially on the same plane as the annular planar surface in said insert plug.

7. In combination with a float controlled liquid dispensing apparatus according to claim 1, a bottle having a circular bottle neck with an external thread, said bottle having a neck opening providing for a force fit therein of the insert plug member of the dispensing apparatus, a bottle cap internally threaded for engagement with the external threads in the bottle neck, said cap when threaded on the bottle neck encapuslating the liquid dispensing apparatus and by contact with the rim portion of the air bell compartment in the float member causes the planar annular seal surface in the float member to make a liquid sealing contact with the annular seal surface in the plug insert of the dispensing apparatus.

* * * * *